US006312322B1

(12) United States Patent
Chang et al.

(10) Patent No.: US 6,312,322 B1
(45) Date of Patent: Nov. 6, 2001

(54) HAND HELD GRINDER

(76) Inventors: Po-Fu Chang, No. 294, Sec. 1, Yuan-Huan N. Rd.; Yung-Yu Lin, No. 137, Ai-Kuo St., both of Fong-Yuan, Taichung Hsien (TW)

( * ) Notice: Subject to any disclaimer, the term of this patent is extended or adjusted under 35 U.S.C. 154(b) by 0 days.

(21) Appl. No.: 09/576,968

(22) Filed: May 24, 2000

(51) Int. Cl.[7] ..... B24B 23/00
(52) U.S. Cl. ..... 451/344; 451/357
(58) Field of Search ..... 451/294, 295, 451/344, 357, 358, 359

(56) References Cited

U.S. PATENT DOCUMENTS

| | | | | |
|---|---|---|---|---|
| 4,245,437 | * | 1/1981 | Marton | 451/456 |
| 5,189,844 | * | 3/1993 | Swarden et al. | 451/24 |
| 5,398,454 | * | 3/1995 | Berner | 451/357 |
| 5,533,925 | * | 7/1996 | Sato | 451/344 |
| 5,607,343 | * | 3/1997 | Keith, Jr. et al. | 451/344 |
| 5,626,510 | * | 5/1997 | Bergner et al. | 451/357 |
| 5,941,764 | * | 8/1999 | Yang | 451/358 |
| 6,066,033 | * | 5/2000 | Kamiya et al. | 451/359 |

* cited by examiner

*Primary Examiner*—Joseph J. Hall, III
*Assistant Examiner*—David B. Thomas
(74) *Attorney, Agent, or Firm*—Bacon & Thomas, PLLC

(57) ABSTRACT

A hand held grinder includes a hollow cowl and a vibration absorber mounted in the cowl. The vibration absorber includes a longitudinal through hole defined through center parallel to the axis of the cowl, and a radial through hole defined in the vibration absorber. The radial through hole communicates with the longitudinal through hole. A socket is defined in the vibration absorber and communicates with the longitudinal through hole and the radial through hole. A transmission device penetrates the vibration absorber and forms a pivot pivotally received in the socket of the vibration absorber. The transmission device has a hollow threaded shaft formed on the exterior end and a neck formed on the other end. A main shaft eccentrically connects and drives the transmission device. The main shaft includes an enlarged external end and a shank extending from the enlarged external end along the axis of the main shaft. The enlarged external end has a diameter that is greater than that of the shank and an end eccentrically containing an eccentric recess to receive the neck of the transmission device. A hollow central body is connected to the cowl and receives the main shaft therein. A connecting shaft is connected to the free end of the shank of the main shaft. A hollow root is connected to the other end of the central body and receives the connecting shaft therein.

12 Claims, 9 Drawing Sheets

HAND HELD GRINDER

BACKGROUND OF THE INVENTION

1. Field of the Invention

The present invention relates to a grinder, and more particularly to a hand held grinder.

2. Description of Related Art

With reference to FIG. 9, a conventional hand held grinder in accordance with the prior art comprises a connecting block (90), a bushing (84) and a motor (81) all received in a housing (80). A hollow shank (91) extends from one end of the connecting block (90) and has a threaded exterior surface. A grinding bit (97) is received in the shank (91) after penetrating the housing (80). A chuck (96) is screwed on the shank (91) to hold the grinding bit (97) in place. Two conical holes (92) are defined in opposite sides of the connecting block (90). These two conical holes (92) communicate with each other and receive a steel ball (94) at the junction between the holes (92). A threaded rod (93) is screwed through opposite sides of the housing (80). The facing ends of the threaded rods (93) are concave so that when the ends of the threaded rods (93) abut the steel ball (94) they will hold the steel ball (94) in place. A protrusion (95) extends from the inside end of the connecting block (90). A bearing (85) is mounted on the protrusion (95) and received in the bushing (84). An eccentric shaft (841) extends from the bushing (84) opposite to the bearing (85). A washer (86) is mounted around the eccentric shaft (841). A shaft (82) extend from the motor (81). A coupling (83) is securely mounted on the shaft (82) of the motor (81). A recess (not numbered) is defined in the coupling (83) opposite to the motor (81) to receive the washer (86).

The coupling (83) is driven by the motor (81) that drives the bushing (84) and makes the bushing (84) revolve eccentrically by means of the eccentric shaft (841). The grinding bit (97) is driven by the connecting block (90) and traces ellipses because the protrusion (95) of the connecting block (90) is mounted in the bearing (85) and the bearing (85) is received in the bushing (84).

Even though the conventional hand held grinder can grind the surface of a part precisely, it has several disadvantages.

1. The steel ball (94) and the threaded rod (93) are metal. They are easily worn out and noisy during operating.

2. The bushing (84) directly drives the connecting block (90) without any limitation. It will cause a significant vibration and make user's hand holding the grinder lose feeling.

The present invention has arisen to mitigate and/or obviate the disadvantages of the conventional hand held grinder.

SUMMARY OF THE INVENTION

In accordance with one aspect of the present invention, a hand held grinder includes a transmission device mounted therein to drive a grinding bit that extends from the grinder. A vibration absorber is mounted on the transmission device. The vibration absorber and the transmission device are pivotally mounted on the end portion of the hand held grinder. The end of the transmission device opposite to the grinding bit is mounted in an eccentric recess of a main shaft to drive the transmission device and make the end of the grinding bit trace ellipses. The hand held grinder has a vibration absorber that can absorb the vibration during operating to prevent the user's hand from losing feeling.

Further benefits and advantages of the present invention will become apparent after a careful reading of the detailed description with appropriate reference to the accompanying drawings.

DETAILED DESCRIPTION OF THE INVENTION

Figure 1:
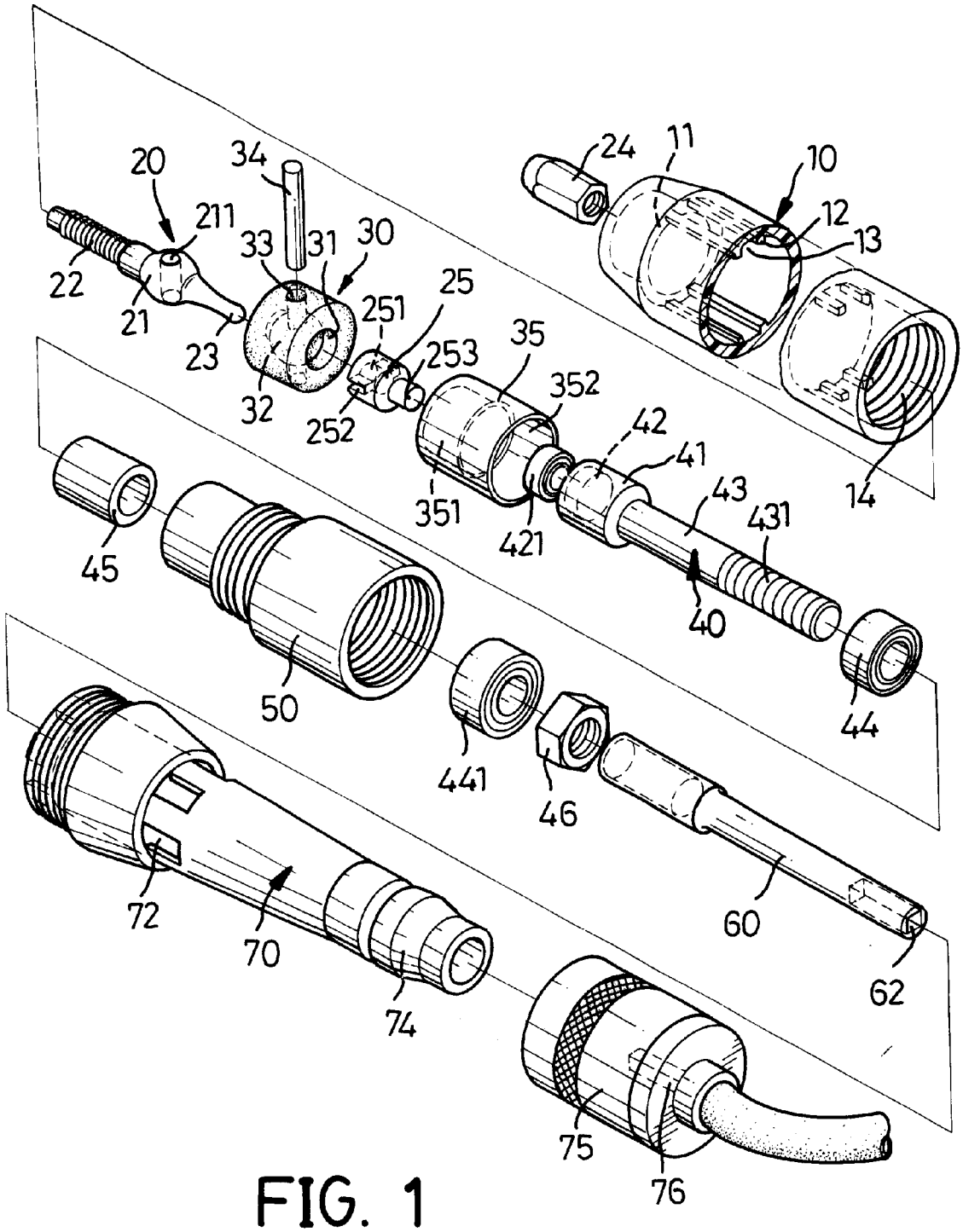
FIG. 1 is an exploded perspective view of a hand held grinder in accordance with the present invention.
Figure 2:
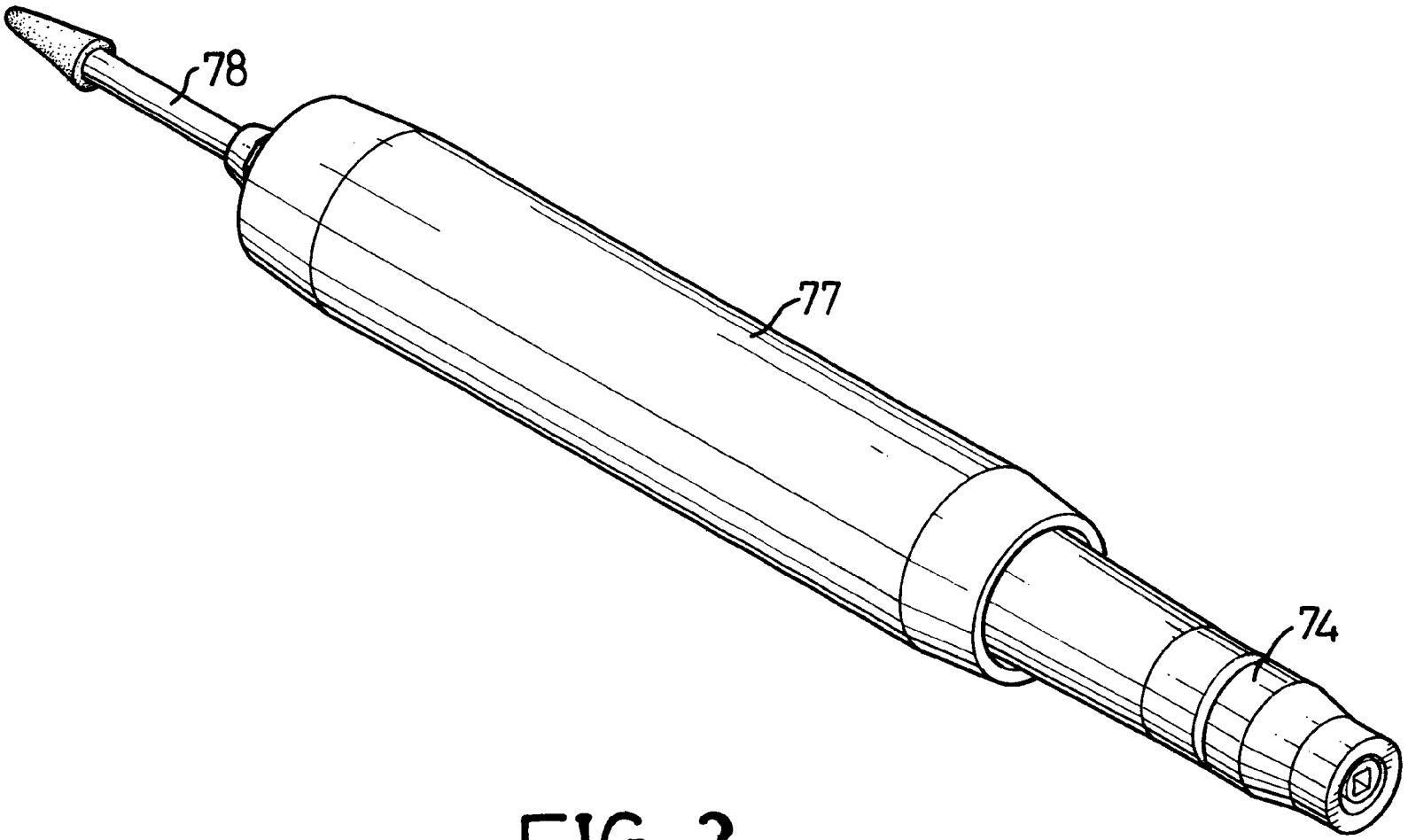
FIG. 2 is a perspective view of the hand held grinder in FIG. 1.
Figure 3:
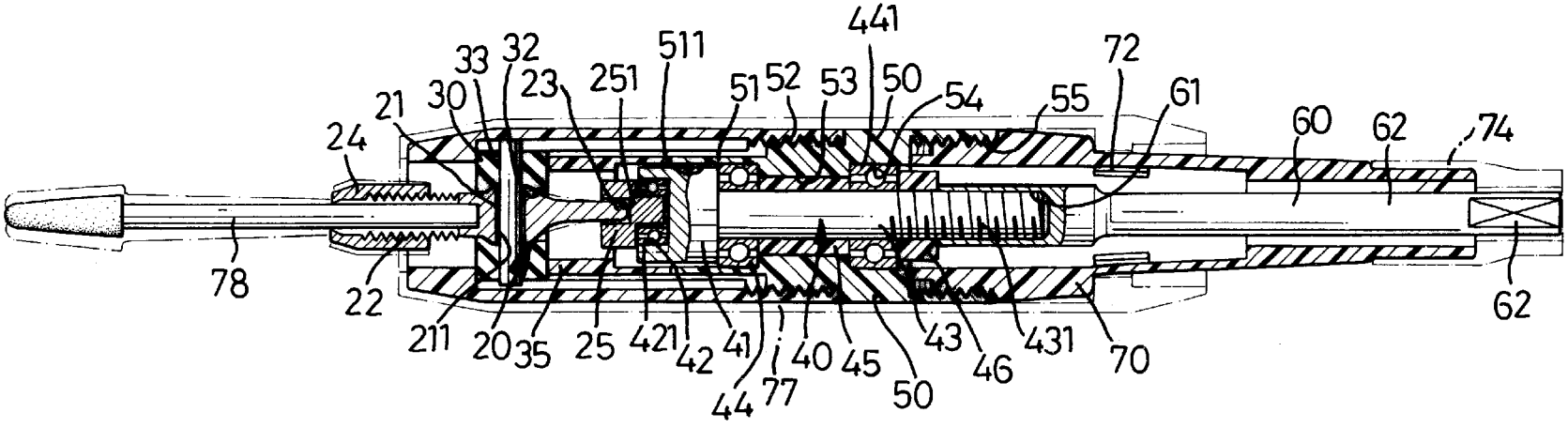
FIG. 3 is a cross-sectional side plan view of the hand held grinder in FIG. 2.
Figure 4:
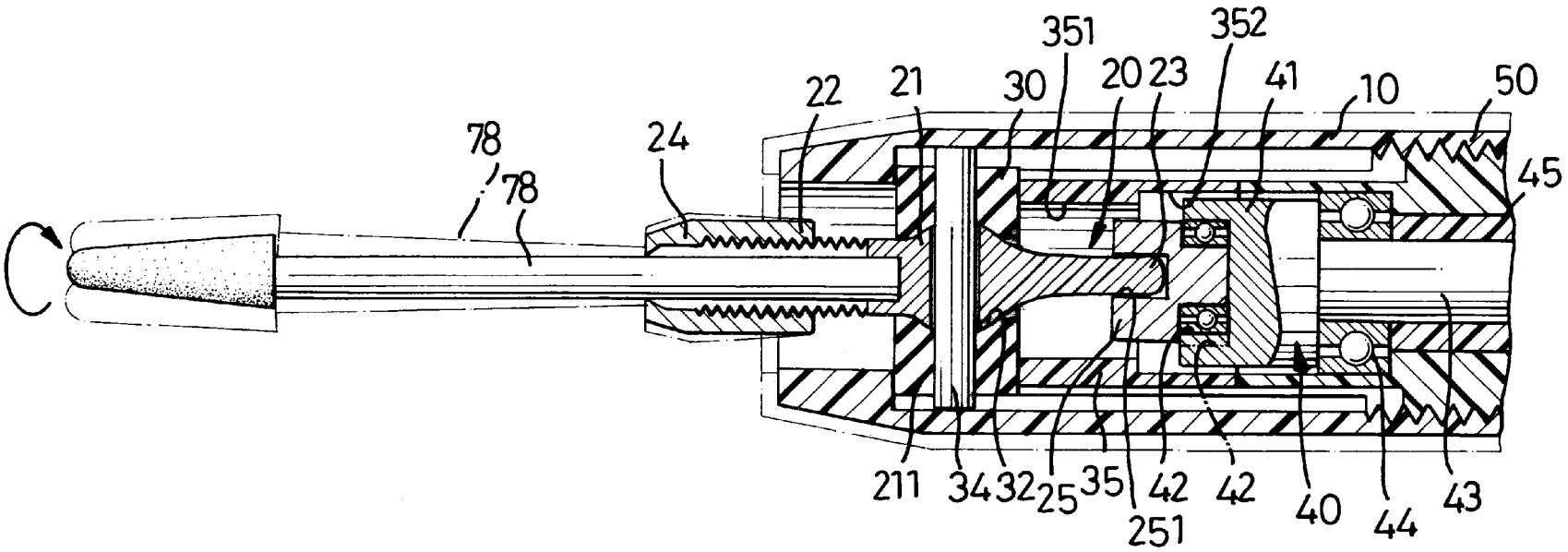
FIG. 4 is an enlarged partial cross-sectional side plan view of the hand held grinder in FIG. 3.

Referring to the drawings and initially to FIGS. 1–3, a hand held grinder in accordance with the present invention comprises a 3-part hollow housing, a vibration absorber (30), a transmission device (20), a main shaft (40) and a connecting shaft (60).

The housing comprises a cowl (10) a central body (50) and a root (70). The cowl (10) has an exterior end, an interior end and a middle portion. The exterior end of the cowl (10) has a shoulder (11) extending radially inward and the interior end of the cowl (10) has an interior thread (14). The middle portion of the cowl (10) has two diametrically opposed pairs of ribs (12) extending inward to define a groove (13) between the ribs (12) in each pair.

The central body (50) is hollow and screwed into the cowl (10) and has an exterior end and an interior end. A neck (51) is formed on the exterior end of the central body (50), and a first passage (511) is defined in the neck (51). A recess (54) is defined in the inner end of the central body (50) and an inner thread (55) is formed between the recess (54) and the interior end of the central body (50). An exterior thread (52) is defined between the two ends of the central body (50) to screw into the interior thread (14) in the cowl (10). The recess (54) in the central body (50) communicates with the first passage (511) via a second passage (53).

The root (70) is hollow and has an interior end forming an exterior thread portion (71) that is screwed into the interior thread (55) of the central body (50). Multiple holes (72) are defined in a periphery of the root (70) for heat dissipation. A male quick release connector (74) is formed on an exterior end of the root (70). A casing (77) encloses the cowl (10), central body (50) and the root (70).

The vibration absorber (30) is received in the cowl (30) and abuts the shoulder (11). The vibration absorber (30) is resilient and has a diameter that is slightly smaller than the distance between the two pair of ribs (12). A longitudinal through hole (31) is defined in a center of the vibration absorber (30) and is parallel to an axis of the cowl (10). A radial through hole (33) is defined in the vibration absorber (30) and corresponding to the grooves (13) on the interior of the cowl (10). The radial through hole (33) communicates with the longitudinal through hole (31). A socket (32) is defined in the vibration absorber (30) and communicates with the longitudinal through hole (31) and the radial through hole (33).

A transmission device (20) is pivotally mounted in and penetrates the vibration absorber (30). A ball-like pivot (21) is formed in a middle portion of the transmission device (20). The pivot (21) is pivotally received in the socket (32) of the vibration absorber (30) and has a hole (211) defined radially through the pivot (21). The hole (211) in the pivot (21) corresponds to the radial through hole (33) in the vibration absorber (30) after the transmission device (20) extending through the vibration absorber (30). The hole (211) in the pivot (21) has a diameter that is greater than that of the radial through hole (33) of the vibration absorber (30). The vibration absorber (30) further includes a pin (34) penetrating the radial through hole (33) of the vibration absorber (30) and the hole (211) of the pivot (21) to hold the pivot (21) in place. The pin (34) has two ends each received in a corresponding one of the grooves (13) in the cowl (10). The transmission device (20) has a first end and a second end. A threaded shaft (22) is formed on the first end of the transmission device (20) and has a chuck (24) screwed onto the threads, and a neck (23) is formed on the second end of the transmission device (20). As shown in FIG. 1, a top of the neck (23) is like a ball.

A coupling (25) is connected to the transmission device (20) and has a first end and a second end. The coupling (25) has a recess (251) defined in the first end to receive the neck (23) of the transmission device (20). A radial drive groove (252) is defined in the first end of the coupling (25) and communicates with the recess (251). A protrusion (253) extends from a center of the second end of the coupling (25).

A sleeve (35) is received in the cowl (10) and abuts one side of the vibration absorber (30) opposite the shoulder (11) in the cowl (10). The sleeve (35) has a first end moveably receiving the coupling (25) therein and a second end (352) communicate with the first end (351). The first end (351) has a diameter which is smaller than that of the second end (352).

The main shaft (40) eccentrically drives the transmission device (20) by means of the coupling (25). The main shaft (40) includes an enlarged external end (41) with the free end facing the coupling (25) and an eccentric recess (42) defined in the free end of the enlarged external end (41). A shank (43) extends longitudinally from the other end of the enlarged external end (41). A coupling bearing (421) is received in the eccentric recess (42). The coupling bearing (421) has a hole (not numbered) defined to securely receive the protrusion (253) from the coupling (25). An external thread (431) is formed on the free end of the shank (43). A main shaft bearing (44) is mounted around the shank (43) and abuts the enlarged external end (41) of the main shaft (40).

The central body (50) neck (51) securely abuts the sleeve (35), and the first passage (511) in the neck (51) receives the main shaft bearing (44) and holds the main shaft bearing (44) in place after the central body (50) is screwed into the cowl (10). The shank (43) of the main shaft (40) passes through the central body (50). A bushing (45) is mounted in the second passage (53) to abut the main shaft bearing (44). A second main shaft bearing (441) is mounted around the shank (43) and received in the recess (54) of the central body (50) to abut the bushing (45). A nut (46) is screwed on the external thread (431) on the free end of the shank (43) to hold the bushing (45) and the second main shaft bearing (441) in place.

A connecting shaft (60) includes a threaded hole (61) defined in the internal end to screw onto the external thread (431) on the main shaft (40) and a polygonal recess (62) defined in the other end.

Figure 5:
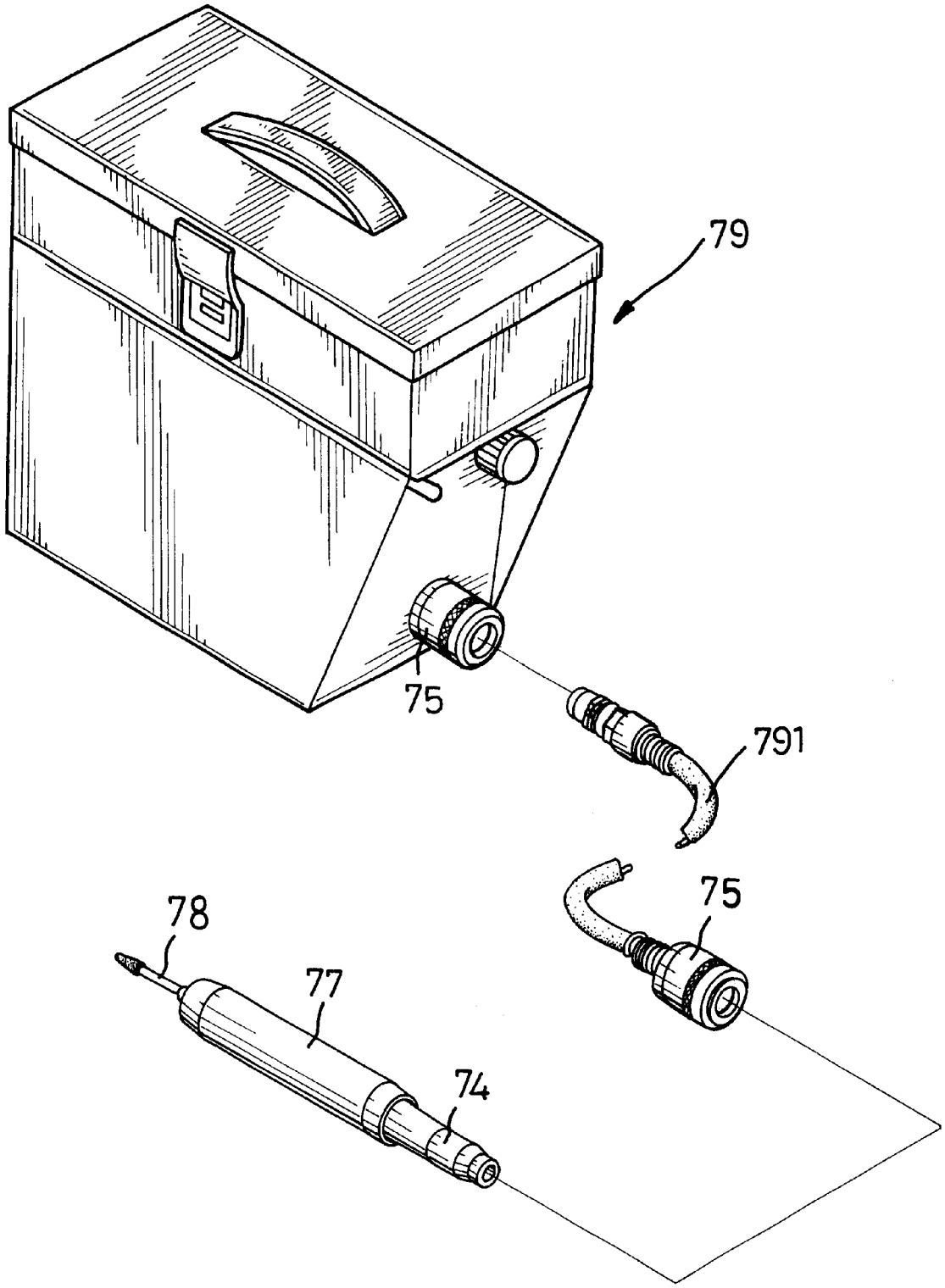
FIG. 5 is an operational perspective view of the hand held grinder in FIG. 2.

Referring to FIGS. 1, 3 and 5, the end of the connecting shaft (60) with a polygonal recess (62) is received in the root (70). A power source (79) includes a drive cable (791) and a rotating cable (76) received in the drive cable (791). The drive cable (791) and the rotating cable (76) are flexible. Having a female quick release connector (75) is attached to the free end of the drive cable (791) to attach to the male quick release connector (74) on the root (70). The rotating cable (76) is polygonal and corresponds to the polygonal recess (62) of the connecting shaft (60). The free end of the rotating cable (76) is received in the polygonal recess (62) when the female quick release connector (75) is attached to the male quick release connector (74) of the root (70) to drive the connecting shaft (60).

With reference to the FIGS. 3 and 5, to operate the hand held grinder, a grinding bit (78) is inserted into the threaded shaft (22) of the transmission device (20) after passing through the chuck (24). Then the chuck (24) is screwed onto the threaded shaft (22) to hold the grinding bit (78) in place, and the main shaft (40) is rotated by the rotating cable (76) and the connecting shaft (60) when the power source (79) is turned on. The coupling (25), the transmission device (20) and the grinding bit (78) are eccentrically driven because the coupling (25) is eccentrically mounted on the main shaft (40) and the neck (23) of the transmission device (20) is pivotally received in the recess (251) of the coupling (25). Then the pin (34) is used as a fulcrum pin and the pivot (21) is used as a fulcrum to make the end of the grinding bit (78) trace ellipses when the transmission device (20) is driven.

Figure 6:
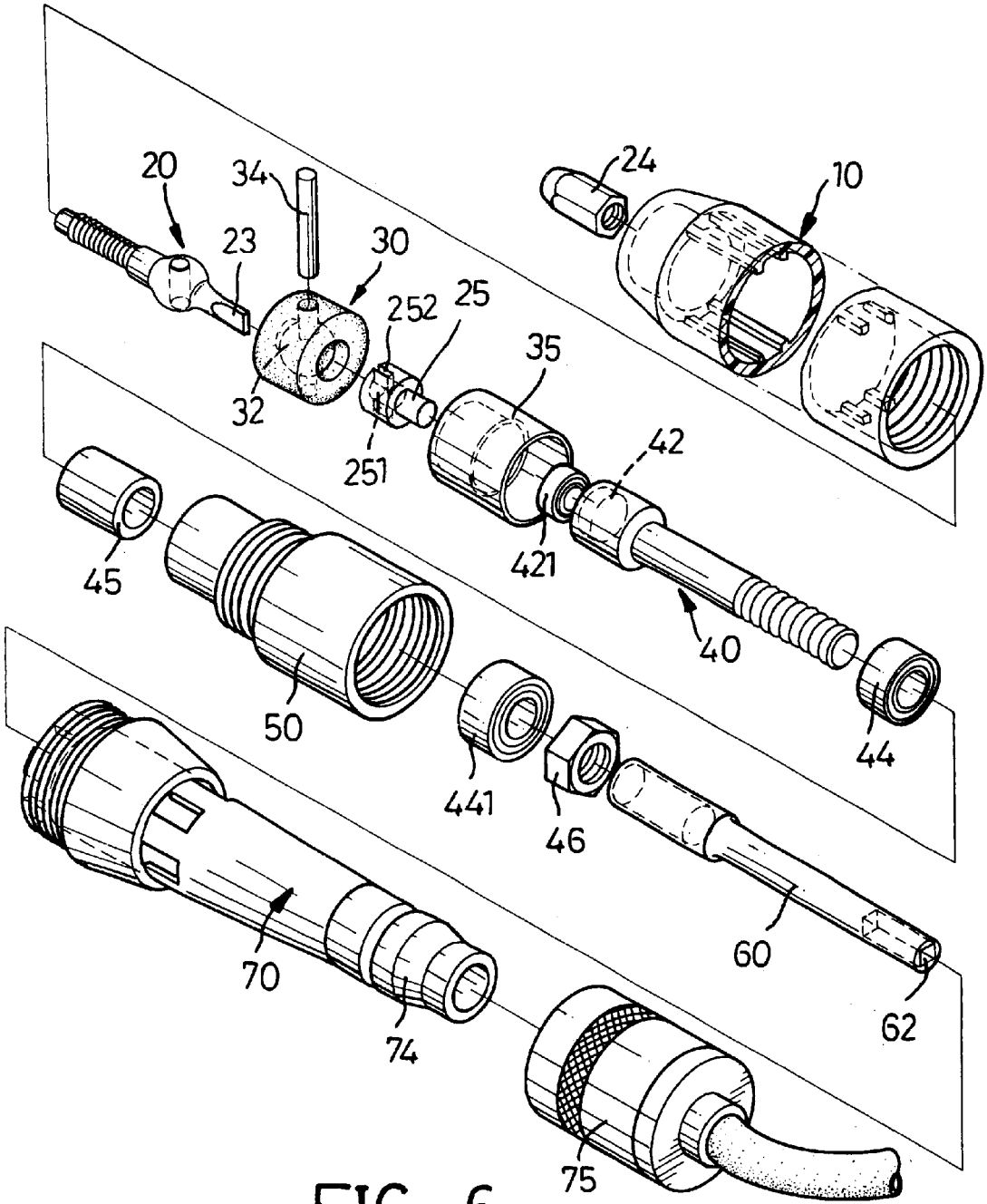
FIG. 6 is an exploded perspective view of a second embodiment of the hand held grinder in accordance with the present invention.
Figure 7:
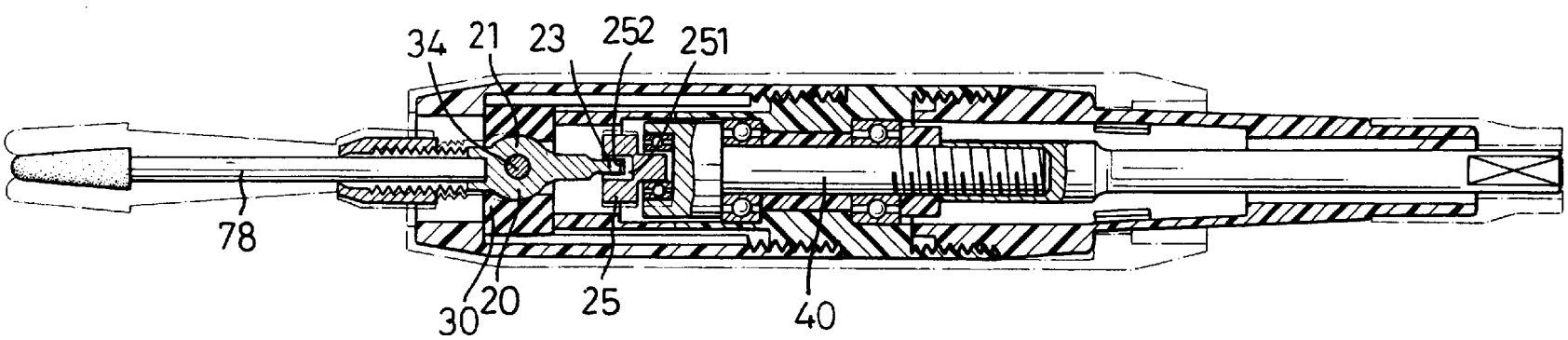
FIG. 7 is a cross-sectional side plan view of the hand held grinder in FIG. 6.

With reference to FIGS. 6–7, in a second embodiment of the present invention, the neck (23) of the transmission device (20) is flat, and plane of the neck (23) is parallel to axis of the hole (211) in the pivot (21). The neck (23) is moveably received in the drive groove (252) in the coupling (25). The pin (34) in the vibration absorber (30) is parallel to the drive groove (252) of the coupling (25) and is used as a fulcrum to make the end of the grinding bit (78) moved as a alternating rectilinear motion when the transmission device (20) is driven.

Figure 8:
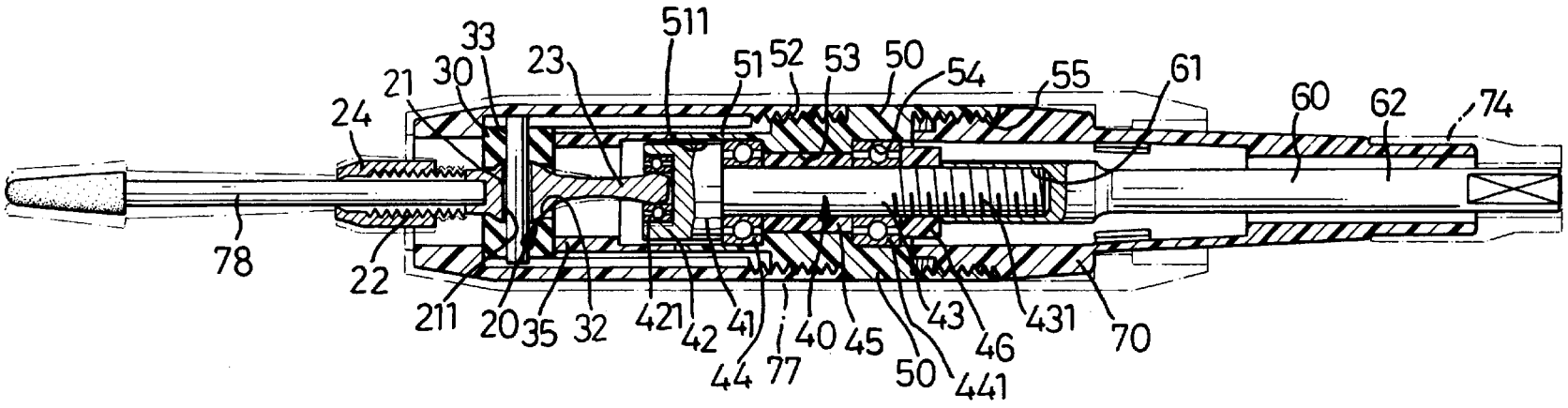
FIG. 8 is a cross-sectional side plan view of a third embodiment of the hand held grinder in accordance with the present invention.
Figure 9:
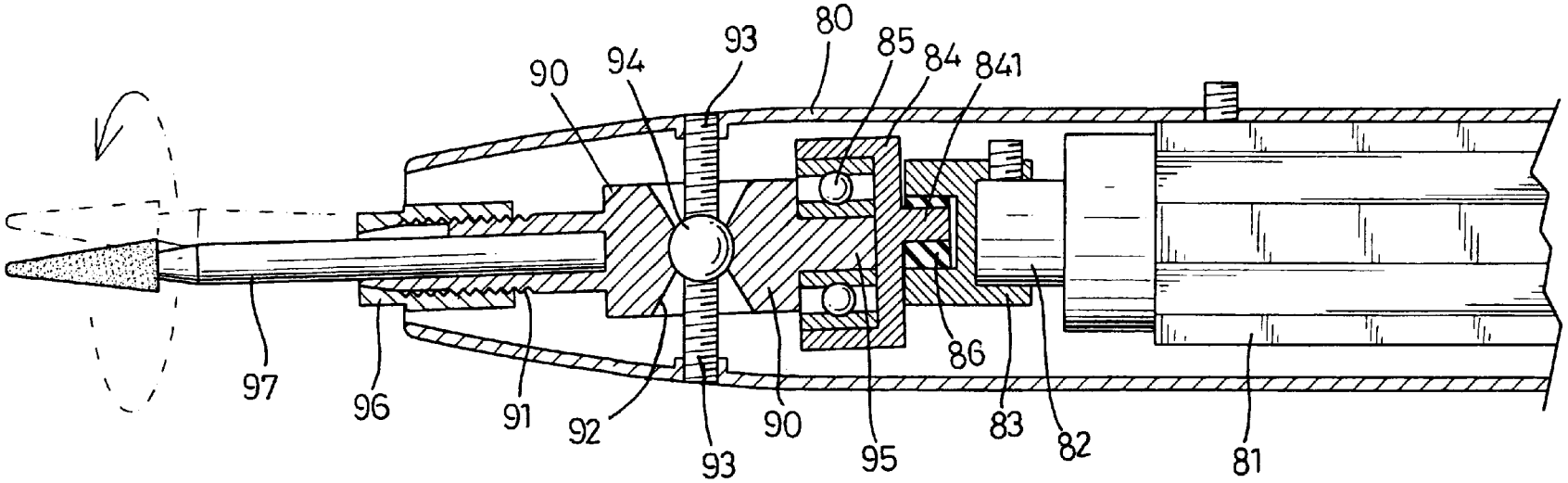
FIG. 9 PRIOR ART
FIG. 9 is an enlarged partial cross-sectional side plan view of a conventional hand held grinder in accordance with the prior art.

With reference to FIG. 8, in a third embodiment of the present invention, the coupling (25) is no used, and the transmission device (20) is driven directly by the main shaft (40) when the rectilinear motion of the grinding bit (78) is unnecessary.

The hand held grinder as described above has several advantages.

1. The hand held grinder has a vibration absorber that can absorb the vibration during operating to prevent the user's hand from loosing feeling because the vibration absorber is made of a flexible material.

2. The vibration absorber in the present invention is flexible so it can reduce the noise from friction when the hand held grinder is operating.

3. The power source and the hand held grinder are separate and can be connected by a quick release connector. It is a convenient design for using and carrying.

4. The hand held grinder in accordance with the present invention has two types of motion. It can expand the useful scope of the hand tool.

Although the invention has been explained in relation to its preferred embodiment, it is to be understood that many other possible modifications and variations can be made without departing from the spirit and scope of the invention as hereinafter claimed.

What is claimed is:

1. A hand held grinder comprising:

a hollow cowl (10);

a vibration absorber (30) mounted in said cowl (10), said vibration absorber (30) including a longitudinal through hole (31) defined through a center thereof and being parallel to a central axis of said cowl (10), and a radial through hole (33) defined in said vibration absorber (30) and communicating with said longitudinal through hole (31);

a socket (32) defined in said vibration absorber (30) and communicating with said longitudinal through hole (31) and said radial through hole (33);

a transmission device (20) extending through said vibration absorber (30) and forming a pivot (21) pivotally received in said socket (32) of said vibration absorber (30), said transmission device (20) having a first end forming a hollow threaded shaft (22) and a second end forming a neck (23);

a main shaft (40) eccentrically connecting and driving said transmission device (20), said main shaft (40) including an enlarged end (41) and a shank (43) extending from said enlarged end (41) along an axis of said main shaft (40), said enlarged end (41) having a diameter that is greater than that of said shank (43) and an end eccentrically containing an eccentric recess (42) to receive said neck (23) of said transmission device (20);

a hollow central body (50) having a first end and a second end, said first end of said central body (50) attached to said cowl (10) and receiving said main shaft (40);

a connecting shaft (60) attached to a free end of said shank (43) of said main shaft (40); and a hollow root (70) attached to said second end of said central body (50) and receiving said connecting shaft (60).

2. The hand held grinder as claimed in claim 1, wherein said cowl (10) includes a first end having a shoulder (11) radially extending inward, a second end forming an internal thread (14), two diametrically opposite pairs of ribs (12) extending inward between said shoulder (11) and said internal thread (14) to define a groove (13) between each pair of ribs (12).

3. The hand held grinder as claimed in claim 2, wherein said vibration absorber (30) abuts said shoulder (11) of said cowl (10) and includes a pin (34) penetrating said radial through hole (33), said pin (34) having two ends each received in one of said diametrically opposed grooves (13) to prevent said vibration absorber (30) from rotating.

4. The hand held grinder as claimed in claim 1 further comprising a sleeve (35) abutting one side of said vibration absorber (30) opposite to said shoulder (11) of said cowl (10), said sleeve (35) having an exterior end (351) near said vibration absorber (30) and an interior end (352), said interior end (352) having a diameter greater than that of said exterior end (351) and communicating with said exterior end (351).

5. The hand held grinder as claimed in claim 1, wherein said enlarged external end (41) of said main shaft (40) has a coupling bearing (421) received in said eccentric recess (42), said coupling bearing (421) having a hole defined to receive said neck (23) therein.

6. The hand held grinder as claimed in claim 5, wherein said shank (43) of said main shaft (40) has an external thread (431) formed on a free end thereof, and said main shaft (40) includes a main shaft bearing (44) mounted around said shank (43) and abutting said enlarged external end (41) of said main shaft (40), a hollow bushing (45) mounted around said shank (43) and abutting said main shaft bearing (44), and a second main shaft bearing (441) mounted around said shank (43) and abutting one end of said bushing (45) opposite to said main shaft bearing (44).

7. The hand held grinder as claimed in claim 6, wherein said connecting shaft (60) includes a first end having a threaded hole (61) defined to screw onto said external thread (431) of said main shaft (40) and a second end having a polygonal recess (62) defined therein.

8. The hand held grinder as claimed in claim 7, wherein said central body (50) includes:

a neck (51) defined in one end thereof to securely abut said sleeve (35);

a first passage (511) defined in said neck (51) to receive said main shaft bearing (44) and hold said main shaft bearing (44) in place;

a recess (54) defined in the other end of said central body (50) to receive said second main shaft bearing (441) therein;

a second passage (53) defined in said central body (50) and communicating said first passage (511) and said recess (54) of said central body (50);

an interior thread (55) defined outside of said recess (54) in said central body (50); and an external thread (52) defined between said two ends of said central body (50) to screw into said internal thread (14) in said cowl (10).

9. The hand held grinder as claimed in claim 8, wherein said root (70) includes a first end forming an external thread (71) to screw into said interior thread (55) of said central body (50), a second end forming a male quick release connector (74) and multiple holes (72) defined in a periphery to dissipate heat.

10. The hand held grinder as claimed in claim 1 further comprising a coupling (25) mounted between said transmission device (20) and said main shaft (40), said coupling (25) including a recess (251) defined in a first side near a center of said coupling (25), a drive groove (252) defined in a face of said coupling (25) along one of diameters and a protrusion (352) extending from the center of a second side of said coupling (25), said protrusion (352) received in said hole of said coupling bearing (421).

11. The hand held grinder as claimed in claim 10, wherein said neck (23) of said transmission (20) is round and pivotally received in said recess (251) of said coupling (25).

12. The hand held grinder as claimed in claim 10, wherein said neck (23) of said transmission device (20) is flat and moveably received in said drive groove (252) of said coupling (25).

* * * * *